US008132702B2

(12) United States Patent
Kunz et al.

(10) Patent No.: US 8,132,702 B2
(45) Date of Patent: Mar. 13, 2012

(54) FASTENER DRIVING TOOL HAVING ENERGY TRANSFER MEMBERS

(75) Inventors: Michael Kunz, Dorndorf (DE); Stefan D. Gensmann, Fruecht (DE); Markus Rompel, Runke/Schadeck (DE)

(73) Assignee: Black & Decker Inc., Newark, DE (US)

( * ) Notice: Subject to any disclaimer, the term of this patent is extended or adjusted under 35 U.S.C. 154(b) by 180 days.

(21) Appl. No.: 12/475,111

(22) Filed: May 29, 2009

(65) Prior Publication Data

US 2009/0294508 A1 Dec. 3, 2009

(30) Foreign Application Priority Data

May 30, 2008 (GB) ..... 0809868.3

(51) Int. Cl.
*B25C 1/06* (2006.01)

(52) U.S. Cl. ..... 227/131

(58) Field of Classification Search ..... 227/8, 131, 227/123, 129

See application file for complete search history.

(56) References Cited

U.S. PATENT DOCUMENTS 4,042,036 A * 8/1977 Smith et al. ..... 173/13
4,121,745 A * 10/1978 Smith et al. ..... 227/8
4,189,080 A * 2/1980 Smith et al. ..... 227/8
4,204,622 A * 5/1980 Smith et al. ..... 227/7
4,323,127 A * 4/1982 Cunningham ..... 173/53
4,558,747 A * 12/1985 Cunningham ..... 173/55
4,721,170 A * 1/1988 Rees ..... 173/13
4,964,558 A * 10/1990 Crutcher et al. ..... 227/8
5,511,715 A * 4/1996 Crutcher et al. ..... 227/131
5,848,655 A * 12/1998 Cooper et al. ..... 173/176
6,196,332 B1 * 3/2001 Albert et al. ..... 173/176
2006/0091177 A1 * 5/2006 Cannaliato et al. ..... 227/8
2008/0006419 A1 * 1/2008 Harcar et al. ..... 173/114
2008/0006426 A1 * 1/2008 Friedrich et al. ..... 173/210
2008/0308592 A1 * 12/2008 Schell et al. ..... 227/8
2009/0236387 A1 * 9/2009 Simonelli et al. ..... 227/8
2009/0294502 A1 * 12/2009 Kunz et al. ..... 227/2
2009/0294504 A1 * 12/2009 Kunz et al. ..... 227/8
2009/0294505 A1 * 12/2009 Kunz et al. ..... 227/8
2009/0294507 A1 * 12/2009 Kunz et al. ..... 227/120

* cited by examiner

*Primary Examiner* — Brian D Nash
(74) *Attorney, Agent, or Firm* — Rhonda L. Barton; Adan Ayala

(57) ABSTRACT

A fastener driving tool arranged to drive fasteners into a workpiece includes at least one electric motor having a central stator and an external rotor arranged to rotate around the stator. The rotor may be in the form of a flywheel. The tool includes an energy transfer member such as a driver arranged to transfer kinetic energy from the rotor to a fastener held in the tool, thereby to drive the fastener from the tool into a workpiece. The electric motor may be a brushless motor. The tool may include two such motors, arranged such that both of their rotors propel the driver simultaneously.

15 Claims, 10 Drawing Sheets

FASTENER DRIVING TOOL HAVING ENERGY TRANSFER MEMBERS

BACKGROUND OF THE INVENTION

1. Field of the Invention

The present invention relates to fastener driving tools, particularly such tools in which the fasteners comprise nails. Thus, the tool according to the invention may comprise a nailer. However, the invention also concerns fastener driving tools for other types of fasteners, including pins, staples, etc.

2. Description of the Related Art

U.S. Pat. No. 4,121,745 discloses an impact tool having two flywheels arranged to propel an impact ram, to drive nails from the tool. A single mains powered AC electric motor rotates both of the flywheels, by means of a belt which is driven by the rotor shaft of the motor, which rotor shall rotates within a surrounding stator.

U.S. Pat. No. 4,323,127 also discloses an impact tool having two flywheels arranged to propel an impact ram, to drive nails from the tool. Each flywheel is rotated by a respective electric motor, via a rotor shaft which rotates within the field windings (stator) of the motor. Each flywheel is attached, by means of a cap screw, to an end of the rotor shaft which extends beyond the field windings of the motor.

BRIEF SUMMARY OF THE INVENTION

The present seeks to provide a fastener driving tool with an improved fastener driving arrangement.

In a first aspect, the present invention provides a fastener driving tool arranged to drive fasteners into a workpiece, including at least one electric motor having a central stator and an external rotor arranged to rotate around the stator, the tool including an energy transfer member arranged to transfer kinetic energy from the rotor directly or indirectly to a fastener held in the tool, thereby to drive the fastener from the tool into a workpiece.

In preferred embodiments of the invention, the rotor and the energy transfer member are arranged to contact each other, thereby transferring kinetic energy from the rotor to the energy transfer member to drive the fastener from the tool into a workpiece. Most preferably, the rotor includes a flywheel.

The energy transfer member preferably includes a driver arranged to contact the rotor (e.g. a rotor including a flywheel) and to be propelled by the rotor to drive a fastener from the tool into a workpiece.

Accordingly, a second aspect of the invention provides a fastener driving tool arranged to drive fasteners into a workpiece, including at least one electric motor having a central stator and an external rotor arranged to rotate around the stator, the rotor including a flywheel, the tool including a driver arranged to contact the flywheel and to be propelled by the flywheel to drive a fastener from the tool into a workpiece.

Advantageously, the energy transfer member, preferably including a driver that directly contacts the rotor, may be arranged to transfer kinetic energy from the rotor directly to a fastener held in the tool, thereby to drive the fastener from the tool into a workpiece. Thus, the driver may be regarded as a ram or impact member, or the driver may include a ram or impact member as a component thereof. As already indicated, the rotor preferably is in the form of a flywheel which is directly contacted by the driver.

The (or each) motor preferably includes a brushless motor. Accordingly, a third aspect of the invention provides a fastener driving tool arranged to drive fasteners into a workpiece, including at least one brushless electric motor and an energy transfer member arranged to transfer kinetic energy from the motor directly or indirectly to a fastener held in the tool, thereby to drive the fastener from the tool into a workpiece.

It is to be understood that any feature of any aspect or embodiment of the invention may be a feature of any other aspect or embodiment of the invention.

Preferably, the rotor of the (or each) motor has a flywheel. The flywheel of the rotor may comprise a component that is separate from the remainder of the rotor and attached thereto. Alternatively, the flywheel of the rotor and the remainder of the rotor may comprise a single piece. Advantageously, the flywheel of the rotor may comprise a lip portion extending at least partially beyond the stator in a direction along an axis of rotation of the rotor about the stator. Preferably, the flywheel of the rotor includes an external surface of the rotor, and more preferably includes a plurality of grooves and ridges. Each groove and ridge preferably lies in a respective plane oriented perpendicular to the axis of rotation of the rotor, i.e. extending around the outer circumference of the rotor. Advantageously, the energy transfer member, in the form of a driver, has a plurality of ridges and grooves on an external surface thereof, arranged to engage with respective grooves and ridges of the flywheel, i.e. arranged longitudinally along at least part of the length of the driver.

The stator of the motor preferably includes a core and windings, and the motor preferably further includes an axial shaft on which the stator is mounted. The motor preferably includes at least one bearing, more preferably, two or more bearings located between the rotor and the shaft, on which the rotor rotates. The rotor preferably includes one or more permanent magnets, for example a plurality of permanent magnets spaced apart from each other and located on an internal surface of the rotor facing the stator. The permanent magnets may be arranged with alternating polarities around the internal surface of the rotor, i.e. with the poles of the magnets facing the stator and alternating in polarity from one magnet to another around the internal surface of the rotor. Alternatively, the permanent magnets may be arranged with constant polarity around the internal surface of the rotor, i.e. all of the magnets oriented with the same magnetic pole (e.g. North, or alternatively South) facing the stator. The rotor preferably is free from or has no windings, and, as already indicated, the motor preferably is a brushless motor.

The motor may be a so-called DC (direct current) brushless motor or an AC (alternating current) brushless motor. Such motors are disclosed in, for example from U.S. Pat. No. 4,882,511, the entire disclosure of which is incorporated herein by reference. Consequently, the electrical structure and functioning of such motors will not be described in detail herein. As persons skilled in the art of electrical motors know, a "DC brushless motor" has this name because it is substantially equivalent to a conventional direct current brushed motor, but instead of the stator providing a permanent magnetic field and the rotor having winding, as is the case in a conventional DC brushed motor, in a DC brushless motor the stator has the windings and the rotor provides the permanent magnets. However, this brushless arrangement also requires that the electrical current provided to the motor be reversed at defined rotational positions of the rotor with respect to the stator. Consequently, a so-called "DC brushless motor" is actually or effectively powered by AC electrical current, and thus it is sometimes called an "AC brushless motor".

In the present invention, the motor preferably is a brushless motor that is powered by poly-phase (multi-phase) alternating current. Most preferably, the motor is powered by three-phase alternating current. The electrical power for the tool may be provided by AC mains power and/or DC battery power, especially by means of one or more rechargeable batteries. The tool preferably includes one or more motor controllers including drive electronics to drive and control the motor(s), and such controller(s) may convert the AC or DC source electrical current into the appropriate current for powering and controlling the motor(s). The motor may, for example, utilize one or more sensors, e.g. Hall effect sensors, to sense the rotational position, and preferably rotational speed, of the rotor with respect to the stator over time. Additionally or alternatively, the tool may utilize EMF (electromotive force) feedback to monitor the rotational position and preferably rotational speed of the rotor. At least in the broadest aspects of the invention, any suitable system of control for the motor(s) may be used. Such control systems, including systems that utilize sensors and/or EMF feedback, are well known to persons skilled in the art of electrical motors, and will not be described in detail herein.

The fastener driving tool according to the invention preferably includes two such electric motors, the energy transfer member being arranged to transfer kinetic energy from the rotors of both motors to a fastener held in the tool, thereby to drive the fastener from the tool into a workpiece. The energy transfer member preferably transfers kinetic energy from both rotors simultaneously, e.g. by travelling between and contacting the rotors, with the rotors rotating in opposite directions to each other.

As already indicated, the fastener driving tool according to the invention preferably is a nailer, the fasteners driven by the tool being nails.

BRIEF DESCRIPTION OF DRAWINGS

An embodiment of the invention will now be described, by way of example, with reference to the accompanying drawings, of which.

DETAILED DESCRIPTION OF THE INVENTION

Figure 1:
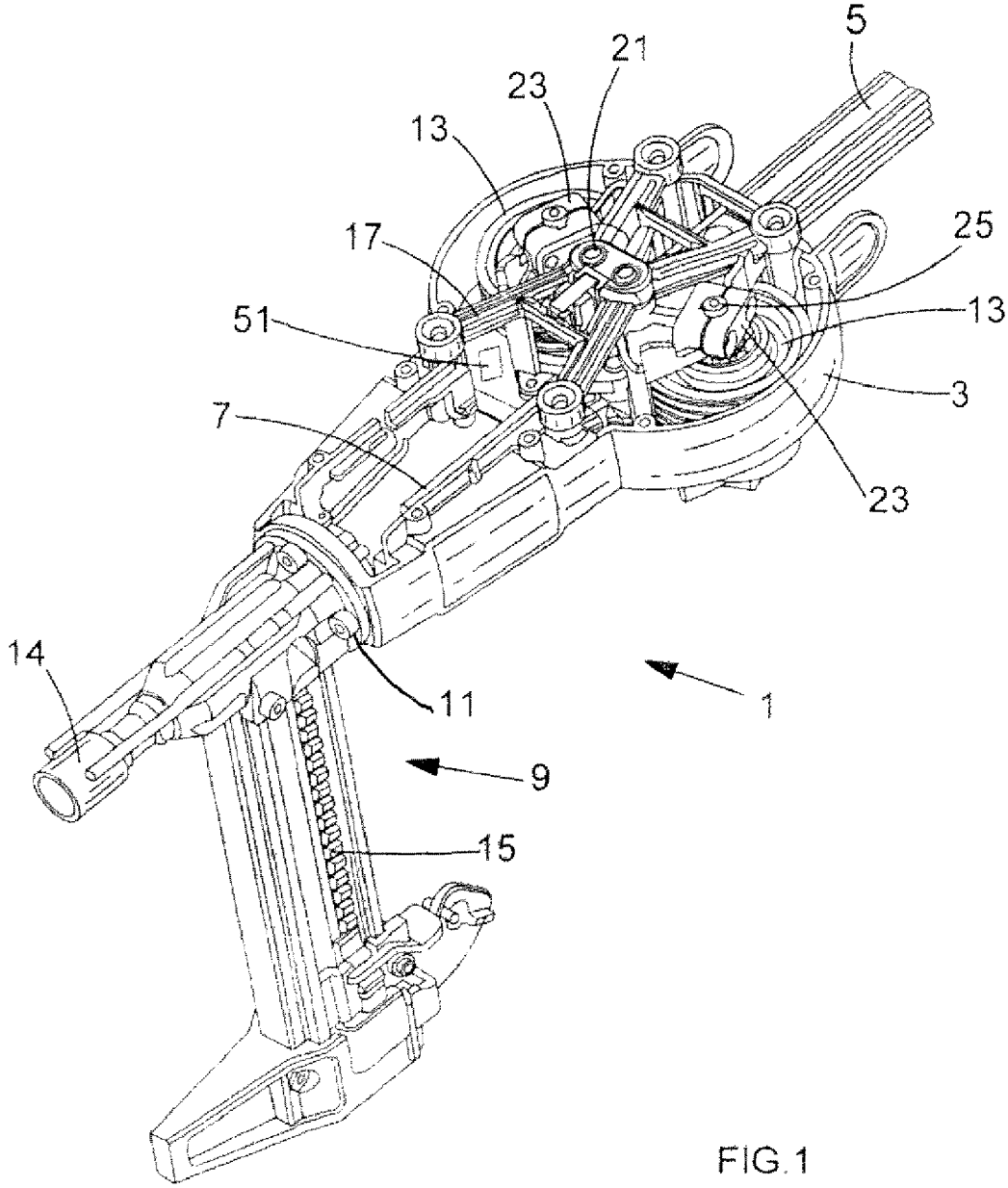
FIGS. 1 to 4 show a fastener driving tool according to the invention, and components thereof.

FIGS. 1 to 4 show a fastener driving tool 1 according to the invention, and various components thereof, including a main body 3, an energy transfer member in the form of a driver 5 and a ram 7, the ram being attached to a front part of the driver, and a fastener supply assembly 9 attached to a front part of the main body 3, for example by means of screws 11. The fastener driving tool 1 includes two electric motors 13, arranged to be contacted by the driver 5 and to propel the driver and ram 7 toward a resiliently retractable nose part 14 of the fastener supply assembly 9 of the tool, to drive a fastener from the tool into a workpiece. In the embodiment of the tool shown in FIGS. 1 and 2, the fasteners are nails 15, and the tool is a nailer. Not shown, but provided in a conventional manner, the fastener driving tool 1 includes a handle, a trigger for firing the tool, and a rechargeable and removable battery for powering the motors 13.

The fastener driving tool 1 is arranged such that when a user wishes to drive or fire a fastener (e.g. a nail 15) into a workpiece (not shown), the user pushes the nose part 14 of the tool against the workpiece, causing the nose part to retract. This causes a safety arrangement of the tool to allow the tool to drive a fastener into the workpiece, once the trigger is pulled. The trigger may be pulled before or after the nose part 14 is retracted (but if pulled before the nose part is retracted, the trigger must remain pulled while the nose part is retracted) to cause the fastener to be fired into the workpiece. When the trigger is in a pulled condition and the nose part is in a retracted condition, the electric motors 13 cause, via flywheels to be described below, the driver 5 to be propelled forwards, thereby causing the ram 7, which is attached to the front of the driver 5 to expel a fastener from the tool and fire it into the workpiece. Such a firing arrangement is disclosed for example in U.S. Pat. No. 4,323,127, referred to above, the entire disclosure of which is incorporated herein by reference.

The two electric motors 13 are mounted in the main body 3 of the tool 1 by means of a frame 17, with each motor 13 being mounted in a respective sub-frame 19 which is attached to the frame 17. The sub-frames 19 preferably are pivotably attached to the frame 17 by means of pivots 21, so that the motors may be moved, for example, rotated toward and away from each other, for example by means of solenoids as disclosed in U.S. Pat. No. 4,323,127, or by other means. When the motors 13 are moved toward each other, they are able to make contact with the driver 5 to propel the driver and the ram 7 forwards. When the motors 13 are moved away from each other, they are unable to make contact with the driver 5.

Each motor 13 is mounted to its respective sub-frame 19 by means of two clamps 23, each of which firmly holds a respective opposite end region of an axial shaft 25 of the motor to its sub-frame 19. As shown, each clamp 23 may comprise one part 23*a* integrally formed with or attached to the remainder of the sub-frame 19, another part 23*b* separate from the first part 23*a*, and screws or other connectors that join the two clamp parts 23*a* and 23*b* together, with the axial shaft 25 firmly gripped between them.

Figure 10:
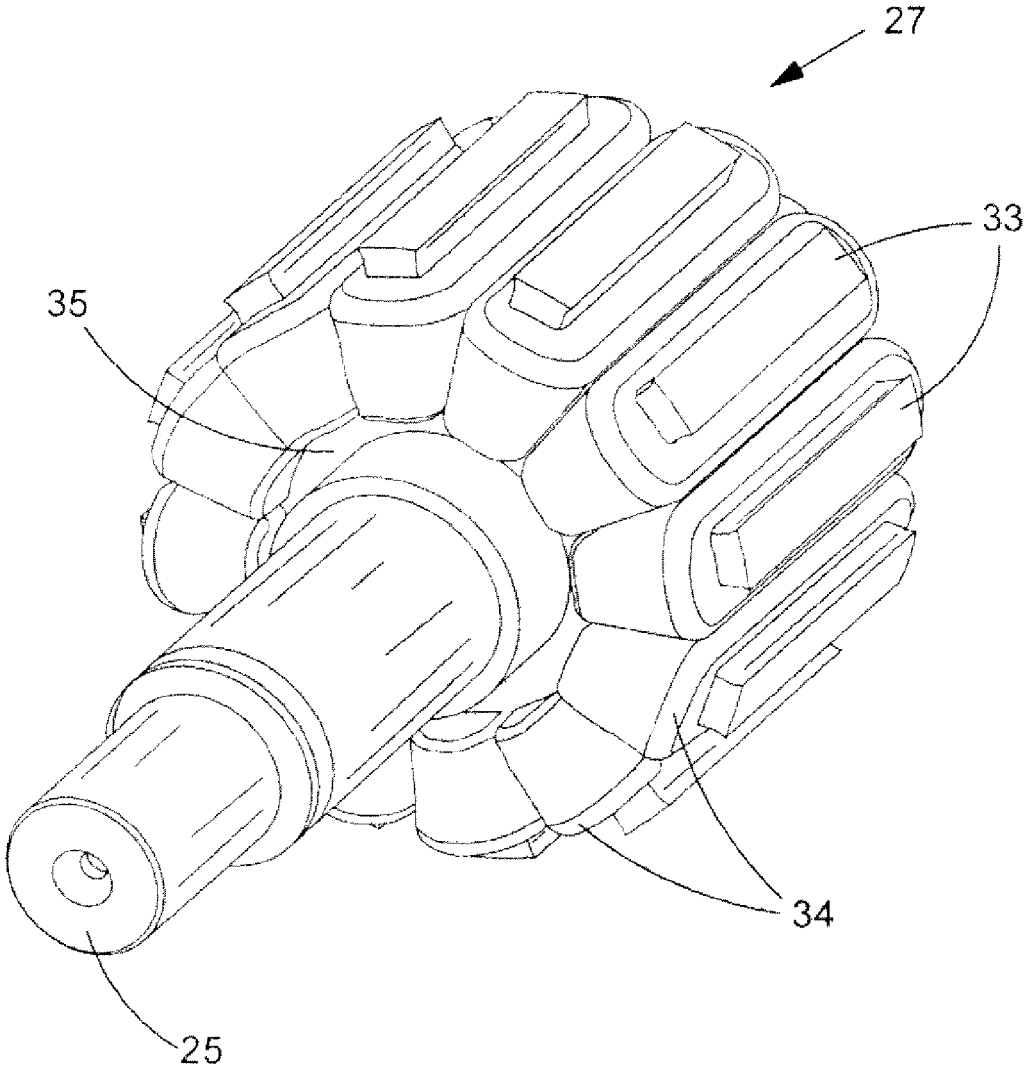

As shown in FIGS. 5 to 10, each motor 13 is a brushless motor having a central stator 27 and an external rotor 29 arranged to rotate around the stator 27, the stator 27 being mounted on the non-rotational axial shaft 25. The rotor 29 is rotationally mounted on two sets of bearings 31, both of which are mounted on the axial shaft 25 adjacent to the stator 27. The stator 27 includes a metal core 28, preferably steel, having a generally cylindrical shape, with a plurality (12 in the embodiment shown) of stator poles 33 projecting radially from a generally cylindrical centre portion 35. Each stator pole 33 carries windings 34 of electrical conductors (e.g. wires) in a manner as disclosed in, for example U.S. Pat. No. 4,882,511. FIG. 10 shows a slightly modified version of the stator 27 with the windings 34 illustrated schematically.

The rotor 29 is very approximately cylindrical in shape, and includes a plurality (10 in the embodiment shown) of spaced-apart permanent magnets 37 attached to an interior surface thereof and arranged around the stator 27 with an air gap 39 between the magnets 37 and the stator 27. The permanent magnets 37 preferably are arranged with constant polarity around the internal surface of the rotor 29, i.e. all of the magnets oriented with the same magnetic pole (e.g. North, or alternatively South) facing the stator 27. Alternatively, the permanent magnets 37 may be arranged with alternating polarities around the internal surface of the rotor 29, i.e. with the poles of the magnets facing the stator 27 and alternating in polarity from one magnet to another around the internal surface of the rotor. The rotor 29 has no windings, and, as already mentioned, the motor 13 is a brushless motor.

The rotor 29, which preferably is formed from metal, especially steel, includes a flywheel 41, comprising an external part of the rotor having an increased outer diameter compared to the remainder of the rotor. As illustrated, the flywheel 41 of the rotor 29 may either be formed integrally with the remainder of the rotor, apart from the permanent magnets 37 which need to be attached to the remainder of the rotor, or the flywheel may be separate and attached to the remainder of the rotor. The flywheel 41 of the rotor is located on the part of the rotor mounted on the bearings 31. In the embodiment of the invention illustrated, the flywheel 41 of the rotor 29 includes a plurality of grooves 43 and ridges 45, each of which lies in a respective plane oriented perpendicular to the axis of rotation of the rotor 29, i.e. extending around the outer circumference of the rotor. As shown in FIGS. 1 to 4, the energy transfer member, in the form of the driver 5, has a plurality of ridges 47 and grooves 49 arranged longitudinally along at least part of the length of an external surface of the driver, arranged to engage with respective grooves 43 and ridges 45 of the flywheel. This inter-engagement of grooves and ridges on the flywheels 41 and the driver 5 increases the surface area of the contact between them, thus improving their frictional engagement, and also provides stabilizing guidance to the contact between the flywheels and the driver.

In use, the two motors 13, including their respective flywheels 41, are rotated in opposite directions to each other, so that the closest regions of their flywheels are moving in the same direction, i.e. forwards toward the nose part 14 of the tool. In this way, the two motors 13 and the two flywheels 41 cooperate with each other to propel the driver 5 between them.

Figure 2:
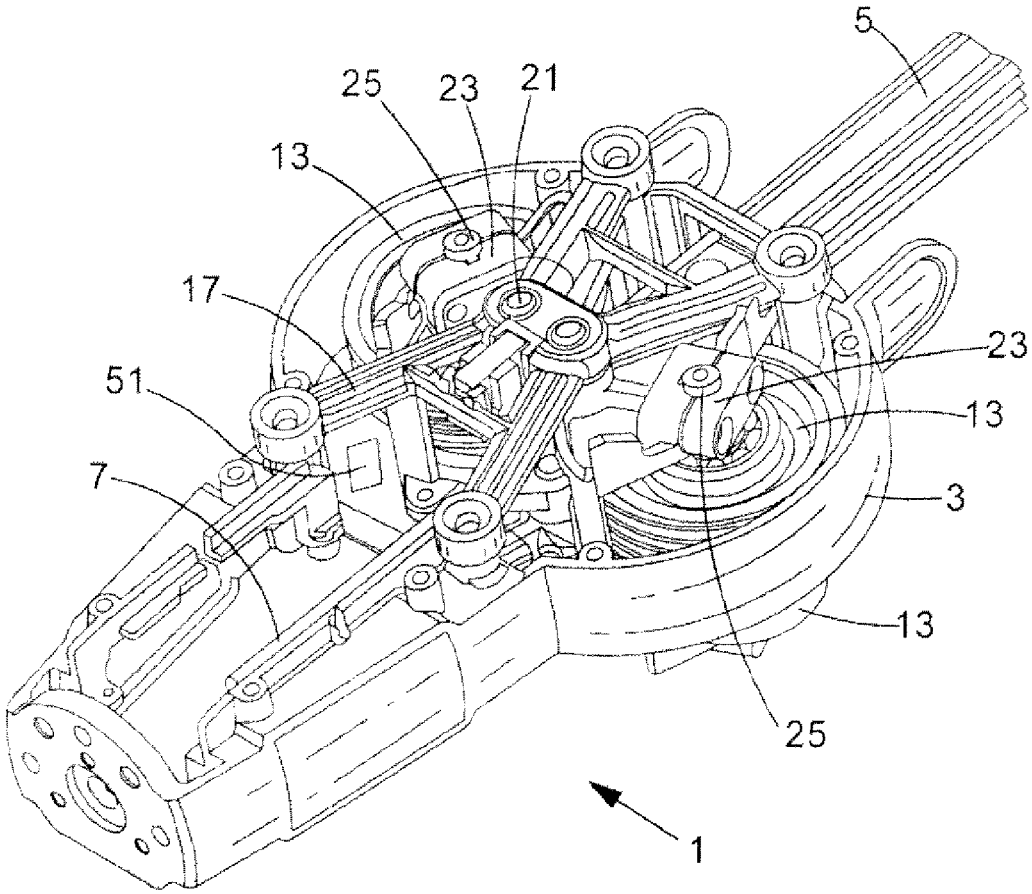
Figure 3:
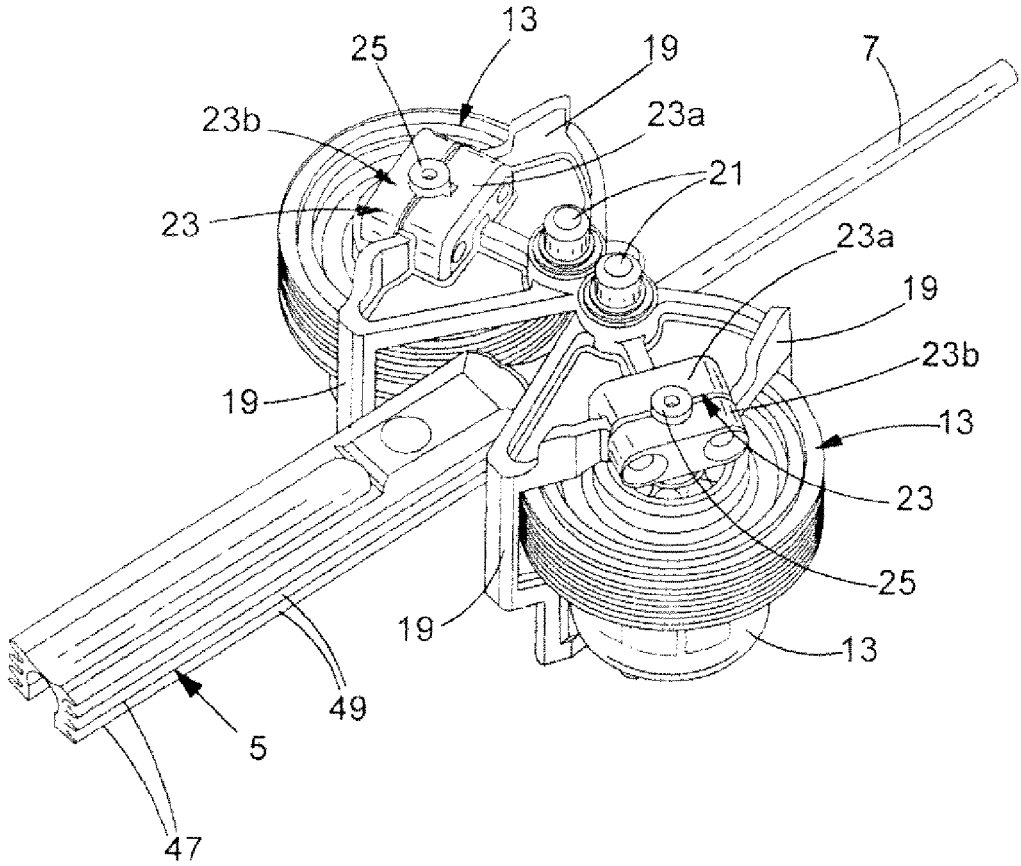
Figure 4:
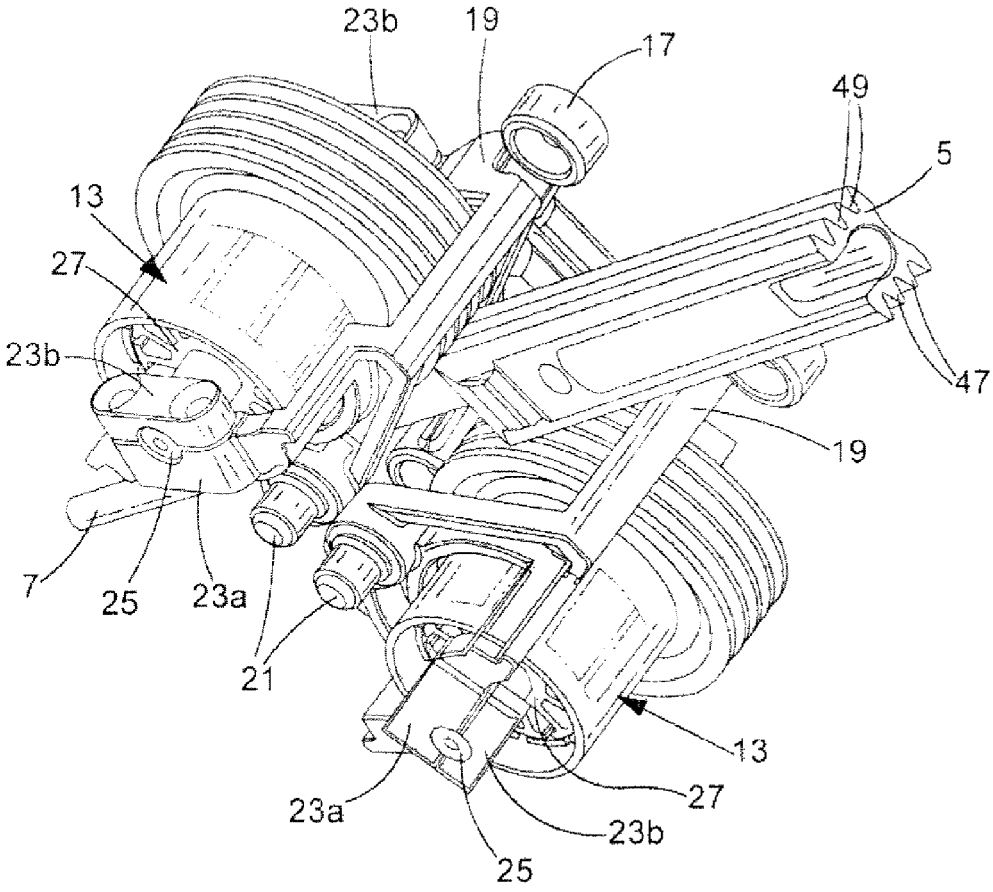
Figure 5:
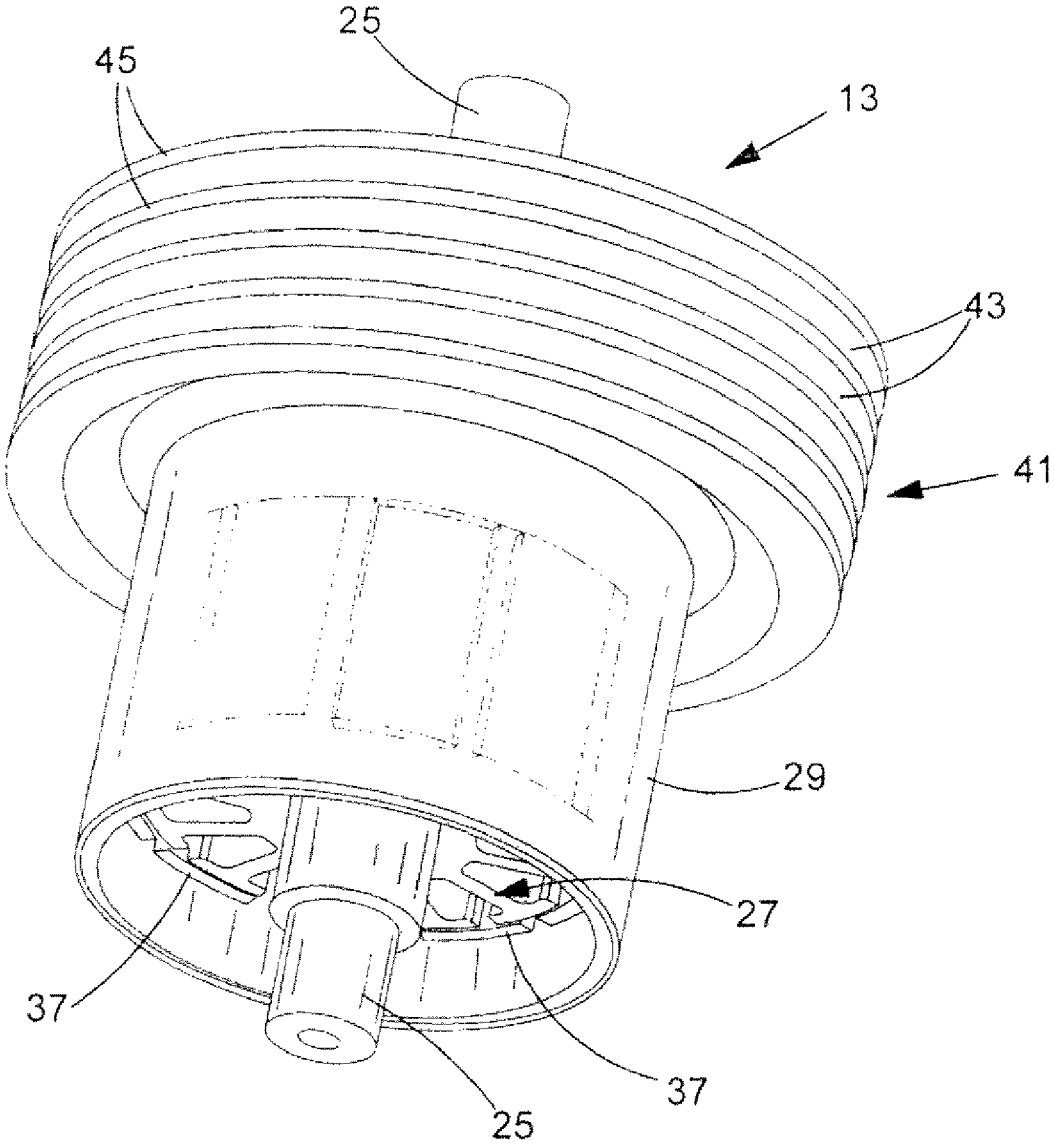
FIGS. 5 to 10 show an electric motor, and components thereof, of a fastener driving tool according to the invention.
Figure 6:
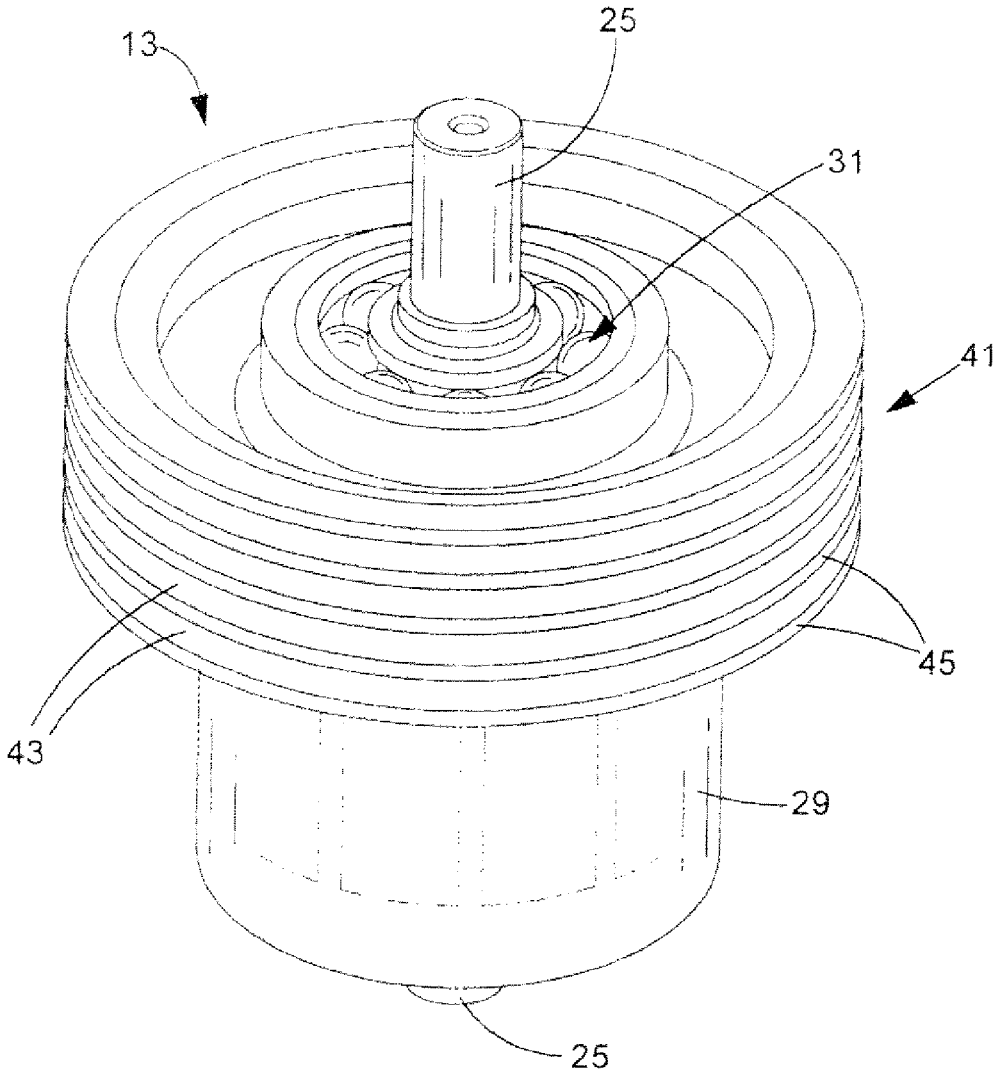
Figure 7:
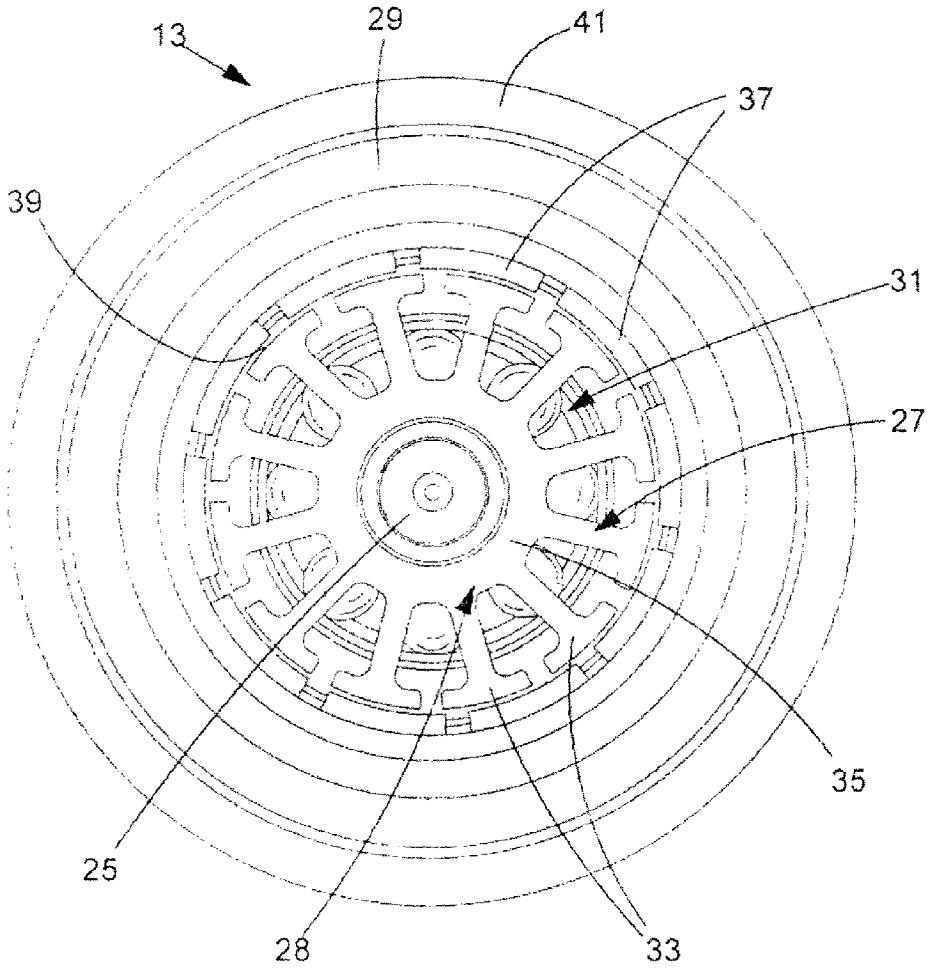
Figure 8:
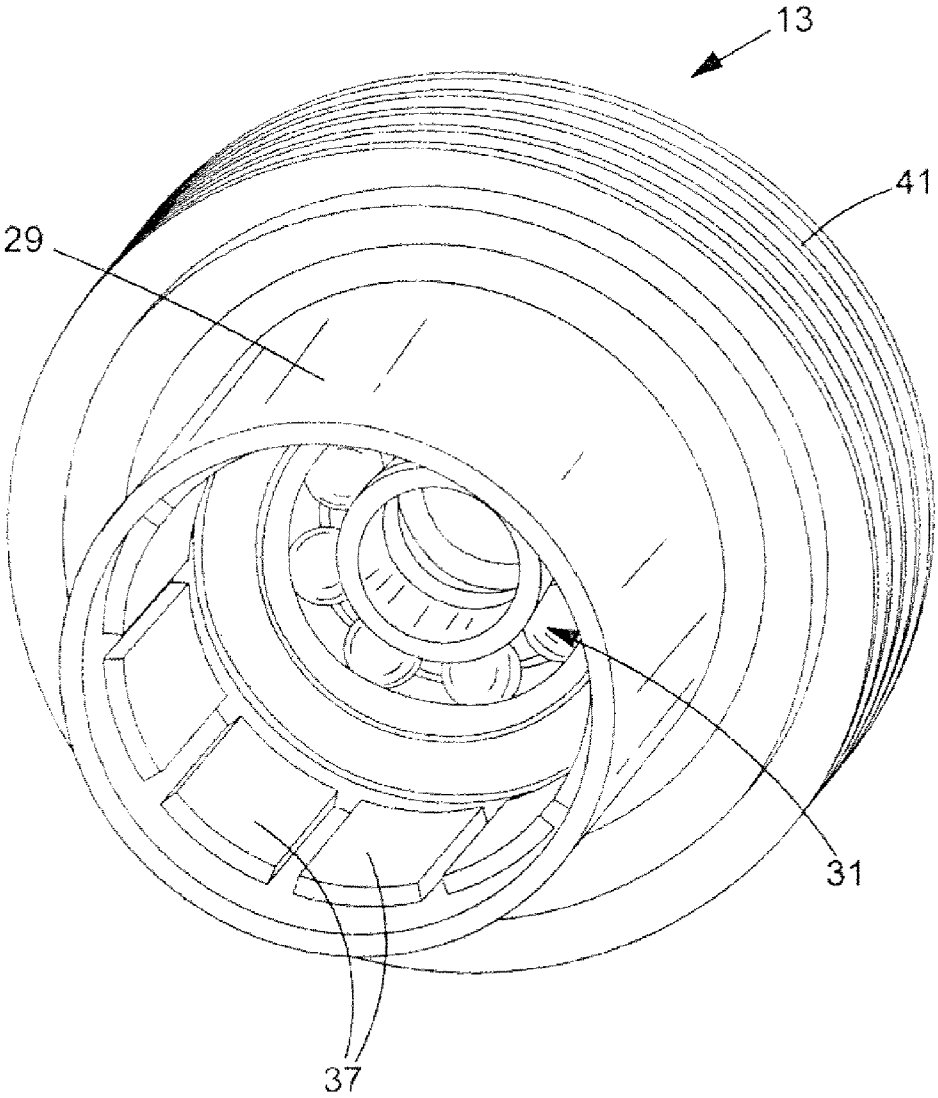
Figure 9:
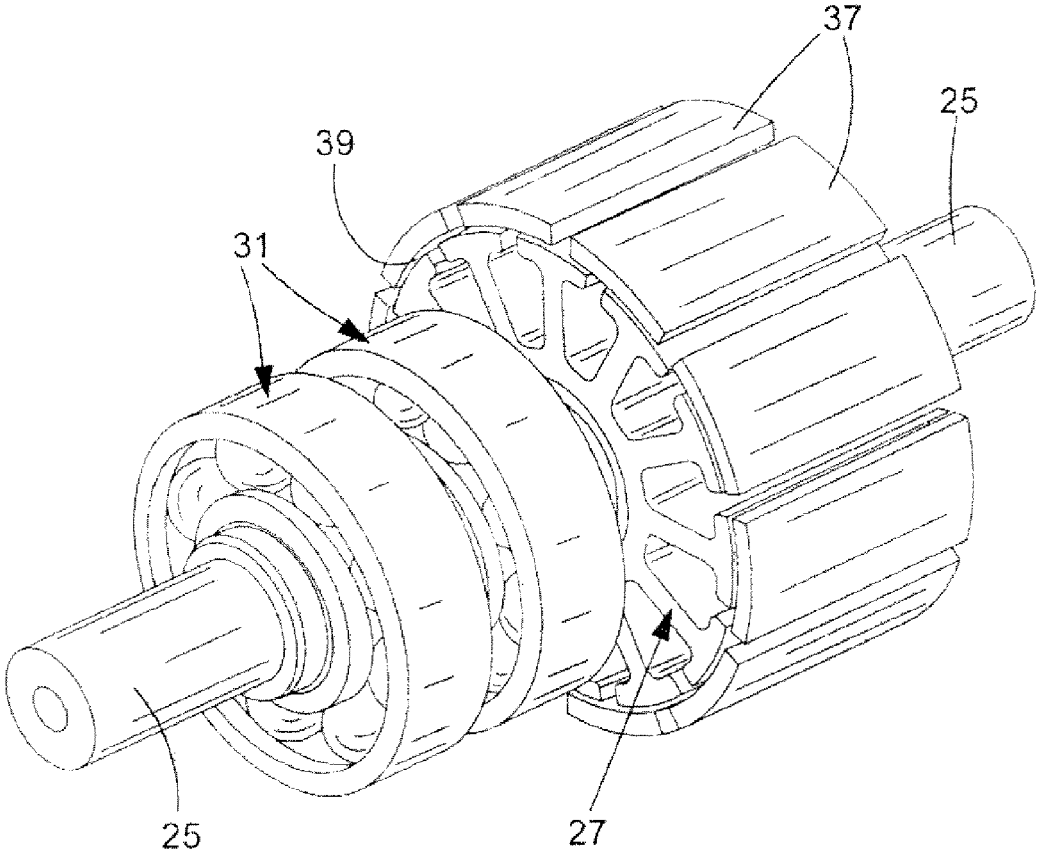

The two motors 13 are controlled by means of a motor control system 51, shown schematically in FIGS. 1 and 2, including control electronics as described above. The control system 51 includes at least one monitoring system arranged to monitor EMF feedback from each motor ("back EMF") and/or includes one or more sensors, especially Hall effect sensors, to determine and control the rotations of the motors. As described above, the tool 1 is powered by AC mains and/or DC battery power.

It will be understood that the above description and the drawings are of a particular example of the invention, but that other examples of the invention are included in the scope of the claims.

We claim:

1. A fastener driving tool arranged to drive fasteners into a workpiece, comprising:

at least one electric motor having a central stator and an external rotor arranged to rotate around the stator, and an energy transfer member arranged to transfer kinetic energy from the rotor directly or indirectly to a fastener held in the tool, thereby to drive the fastener from the tool into a workpiece, wherein the rotor comprises a plurality of permanent magnets spaced apart from each other and located on an internal surface of the rotor facing the stator.

2. The fastener driving tool according to claim 1, wherein the rotor and the energy transfer member are arranged to contact each other, thereby transferring kinetic energy from the rotor to the energy transfer member to drive the fastener from the tool into a workpiece.

3. The fastener driving tool according to claim 1, wherein the fastener comprises a nail and the tool comprises a nailer.

4. The fastener driving tool according to claim 1, wherein the at least one electric motor is a brushless motor.

5. The fastener driving tool according to claim 1, comprising two said electric motors and rotors, the energy transfer member being arranged to transfer kinetic energy from the rotors of both motors to a fastener held in the tool, thereby to drive the fastener from the tool into a workpiece.

6. The fastener driving tool according to claim 5, arranged such that, in use, the energy transfer member is configured to transfer kinetic energy from both rotors simultaneously.

7. A fastener driving tool arranged to drive fasteners into a workpiece, comprising:

at least one electric motor having a central stator and an external rotor arranged to rotate around the stator, and an energy transfer member arranged to transfer kinetic energy from the rotor directly or indirectly to a fastener held in the tool, thereby to drive the fastener from the tool into a workpiece, wherein the rotor comprises a flywheel, and the flywheel comprises a lip portion extending at least partially beyond the stator in a direction along an axis of rotation of the rotor about the stator.

8. The fastener driving tool according to claim 4, wherein the flywheel of the rotor comprises a component that is separate from the remainder of the rotor and attached thereto.

9. The fastener driving tool according to claim 4, wherein the flywheel of the rotor and the remainder of the rotor, excluding any permanent magnets, comprise a single piece.

10. A fastener driving tool arranged to drive fasteners into a workpiece, comprising:

at least one electric motor having a central stator and an external rotor arranged to rotate around the stator, and an energy transfer member arranged to transfer kinetic energy from the rotor directly or indirectly to a fastener held in the tool, thereby to drive the fastener from the tool into a workpiece, wherein the rotor comprises a flywheel, the flywheel further comprising an external surface of the rotor, and having a plurality of grooves and ridges.

11. A fastener driving tool arranged to drive fasteners into a workpiece, comprising:

at least one electric motor having a central stator and an external rotor arranged to rotate around the stator, and an energy transfer member arranged to transfer kinetic energy from the rotor directly or indirectly to a fastener held in the tool, thereby to drive the fastener from the tool into a workpiece, wherein the rotor comprises a flywheel, and the energy transfer member comprises a driver arranged to contact the flywheel and to be propelled by the flywheel to drive a fastener from the tool into a workpiece, and wherein the driver has a plurality of ridges and grooves on an external surface thereof, arranged to engage with respective grooves and ridges of the flywheel.

12. The fastener driving tool according to claim 11, wherein the driver is arranged to transfer kinetic energy from the flywheel directly to a fastener held in the tool, thereby to drive the fastener from the tool into a workpiece.

13. The fastener driving tool according to claim 12, wherein the driver includes a ram or impact member as a component thereof, the ram or impact member being arranged to contact a fastener held in the tool, to drive the fastener from the tool into a workpiece.

14. A fastener driving tool arranged to drive fasteners into a workpiece, comprising:

at least one electric motor having a central stator and an external rotor arranged to rotate around the stator, and an energy transfer member arranged to transfer kinetic energy from the rotor directly or indirectly to a fastener held in the tool, thereby to drive the fastener from the tool into a workpiece, further comprising one or more sensors arranged to determine the rotational position of the rotor with respect to the stator, in use, and at least one monitoring system arranged to monitor EMF feedback from the at least one electric motor to determine the rotational position of the rotor with respect to the stator, in use.

15. The fastener driving tool according to claim 14, further comprising a motor control system arranged to control the at least one electric motor, the motor control system incorporating said at least one of said one or more sensors and said at least one monitoring system.

* * * * *